United States Patent [19]

Fish

[11] Patent Number: 4,756,480

[45] Date of Patent: Jul. 12, 1988

[54] APPARATUS FOR FLUSHING DRAINS

[76] Inventor: Michael W. Fish, P.O. Box 1522, Soquel, Calif. 95073

[21] Appl. No.: 117,458

[22] Filed: Nov. 2, 1987

Related U.S. Application Data

[63] Continuation of Ser. No. 865,914, May 13, 1986, abandoned, which is a continuation of Ser. No. 598,263, Apr. 9, 1984, abandoned.

[51] Int. Cl.[4] ..... B05B 1/28

[52] U.S. Cl. ..... 239/288.5; 4/255; 16/114 R; 16/124; 16/DIG. 24; 239/574; 239/581.1; 239/588

[58] Field of Search ..... 239/288, 288.3, 288.5, 239/525, 588, 104, 569, 574, 581.1; 134/168 C, 172; 4/255, 256, 257; 16/110 R, 114 R, 124, DIG. 12, DIG. 24, DIG. 25

[56] References Cited

U.S. PATENT DOCUMENTS

| | | | |
|---|---|---|---|
| 758,482 | 4/1904 | Smith | 16/114 R |
| 1,085,052 | 1/1914 | Lunney | 4/255 |
| 1,658,645 | 2/1928 | McGee | 239/288 |
| 1,840,488 | 1/1932 | Connell | 239/525 |
| 2,289,889 | 7/1942 | Stick et al. | 239/288.3 |
| 3,318,535 | 5/1967 | New | 239/310 |
| 3,405,669 | 10/1968 | Nimrick | 239/310 |
| 3,537,113 | 11/1970 | Elzner | 134/168 C |
| 3,770,204 | 11/1973 | Schuster | 239/288.5 |

*Primary Examiner*—Andres Kashnikow
*Assistant Examiner*—Michael J. Forman
*Attorney, Agent, or Firm*—Schapp and Hatch

[57] ABSTRACT

A drain unclogging and clearing apparatus providing an elongated rigid tube having a constricting nozzle at one end capable of increasing the velocity of water flowing through the tube and ejecting such water in a jet, the nozzle being surrounded by a flared resilient splash guard. The opposite end of the tube is provided with a quick acting manually controlled ball plug valve connected to a supply hose which, in turn, is connectable to either a male or female threaded faucet. An oval ring-shaped handle is adjustably mounted on the tube approximately one-third of the length of the tube from the valve and is provided with studs for carrying male and female hose adapters.

7 Claims, 1 Drawing Sheet

APPARATUS FOR FLUSHING DRAINS

This is a continuation of co-pending application Ser. No. 865,914 filed on May 13, 1986, now abandoned, as a file wrapper continuation of original application Ser. No. 598,263 filed Apr. 9, 1984, now abandoned.

BACKGROUND OF THE INVENTION

1. Field of the Invention

This invention relates to devices for removing temporary blockages from toilet, sink and lavatory drains, and more particularly to devices utilizing household water pressure for such purposes.

2. Description of the Prior Art

Previous devices for removing drain blockages have employed household water pressure to force material blocking the drain on through the drain to soil pipelines. These devices generally provide a flexible hose attachable at one end to a faucet or other source of household water under pressure. The other end of the hose is provided with a bell-shaped "plumber's helper" type of device capable of imparting pressure surges to the contents of the drain when forcibly pushed downwardly against the drain outlet and released. Representative of these approaches are the following patents:

| U.S. Pat. No. | Name of Patentee |
|---|---|
| 1,110,715 | D. J. Reese |
| 2,500,404 | T. S. Donnelly |
| 2,535,092 | F. S. Rettinger |

Typically, these patents contemplate use of water pressure only to clear the drains, with the water being confined to the drain area by the bell shaped resilient plumber's helper devices. Moreover, each of these devices rely on the household faucets, to which they are connectible, to turn the water on and off.

U.S. Pat. No. 3,672,380 to Frank Schuster provides a valve at the plumber's helper for turning the water on and off independently of the household faucet to which the supply hose is attached. Ths position of this valve forces the user to immerse his hand in the backed up sewage.

Another approach is to replace the flexible, bell-shaped plumber's helper with a solid closing member having a gasket intended to effect a seal between the closing member and the area of the household appliance surrounding the drain opening. Such structure is exemplified in U.S. Pat. No. 1,395,125 to W. E. D. Lewis, et al.

U.S. Pat. No. 4,320,539 to S. Li provides a rounded resilient block of material around the lower end of a water injection tube, intended to seal the tube to the drain, and has a plunger valve at its upper end for controlling flow of water through the tube.

SUMMARY OF THE INVENTION

The apparatus of the present invention relies upon velocity of a jet of water injected into the blocked drain rather than mere water pressure. To this end, the water passes through a tapered nozzle capable of increasing the velocity of the water jet emanating from the nozzle over the velocity of the water flowing through the supply hose and tube leading to the nozzle. It has been found that the apparatus of the present invention is more effective than the prior art because the relatively higher velocity jet churns up and disassociates the materials blocking the drain, rather than relying upon mere water pressure or pressure surges to move the impacted materials.

A splash guard is provided to prevent unwanted upward deflection of the jet of water, but the splash guard of the present invention does not provide a tight seal of the type contemplated by the prior art and thus does not impede the velocity of the water jet by confining the water in the area surrounding the drain opening.

A manually operable, quick acting valve is supplied at the upper end of the present device for turning the jet on and off and for controlling its intensity. The valve end of the device is connectible to a flexible hose which, in turn, is adapted for connection to an appliance faucet.

The present apparatus is adapted for connection to either male or female threads in the faucet or hydrant to which it is attached and, for this purpose, is provided with male and female hose adapters.

A manipulating handle of oval, ring shape is mounted on the tube about two-thirds of the way up from the nozzle, and the male and female hose adapters are carried on complimentarily threaded portions provided in one of the longer sides of the handle.

It is therefore an object of the present invention to provide an improved apparatus for flushing drains utilizing a relatively high velocity jet of water for unclogging such drains.

Another object of the present invention is to provide a device of the character described in which the flow of water to the nozzle is controllable from a distance so as not to require submersion of the hand of the user in waste water or sewage.

A further object of the present invention is to provide an apparatus of the character set forth having manually graspable portions for facilitating holding the device in place against back surge from the water jet.

Yet another object of the present invention is to provide apparatus of the character described in which back pressure is reduced or eliminated at the nozzle which produces the relatively high velocity water jet.

Other objects and features of advantage will become apparent as the specification progresses and from the claims.

Figure 1:
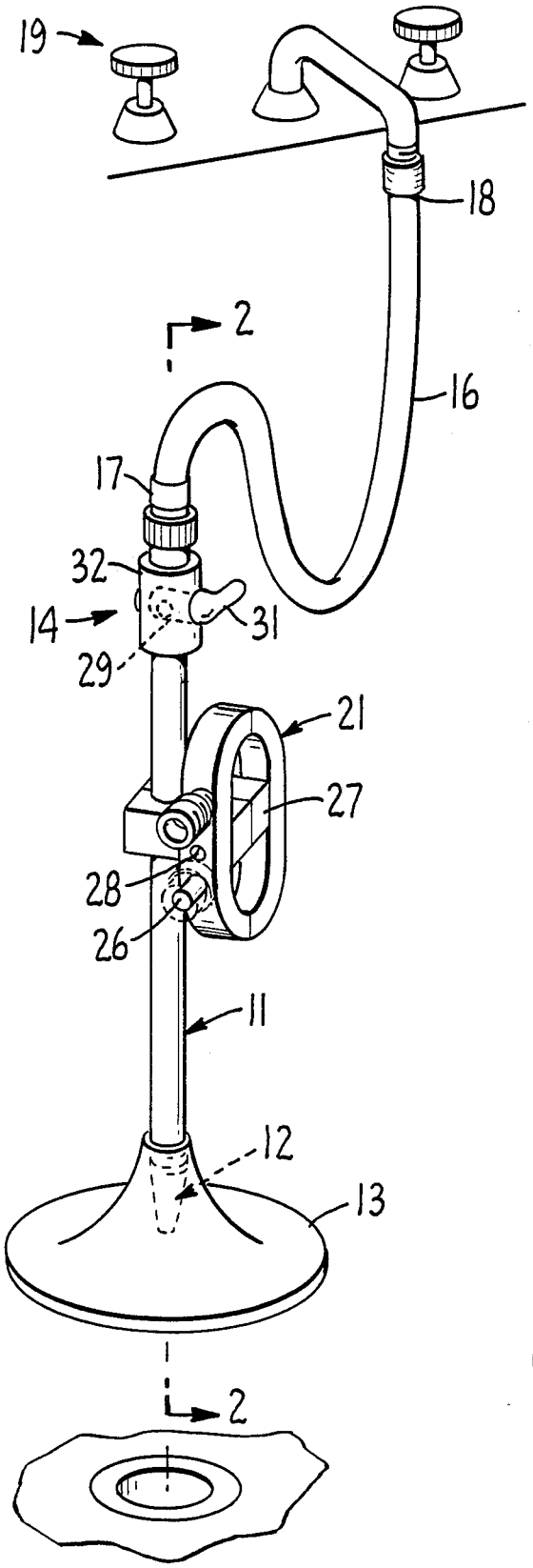
FIG. 1 is a perspective view of an apparatus for flushing drains constructed in accordance with the present invention and illustrated in operative association with the water faucet and a drain opening.
Figure 2:
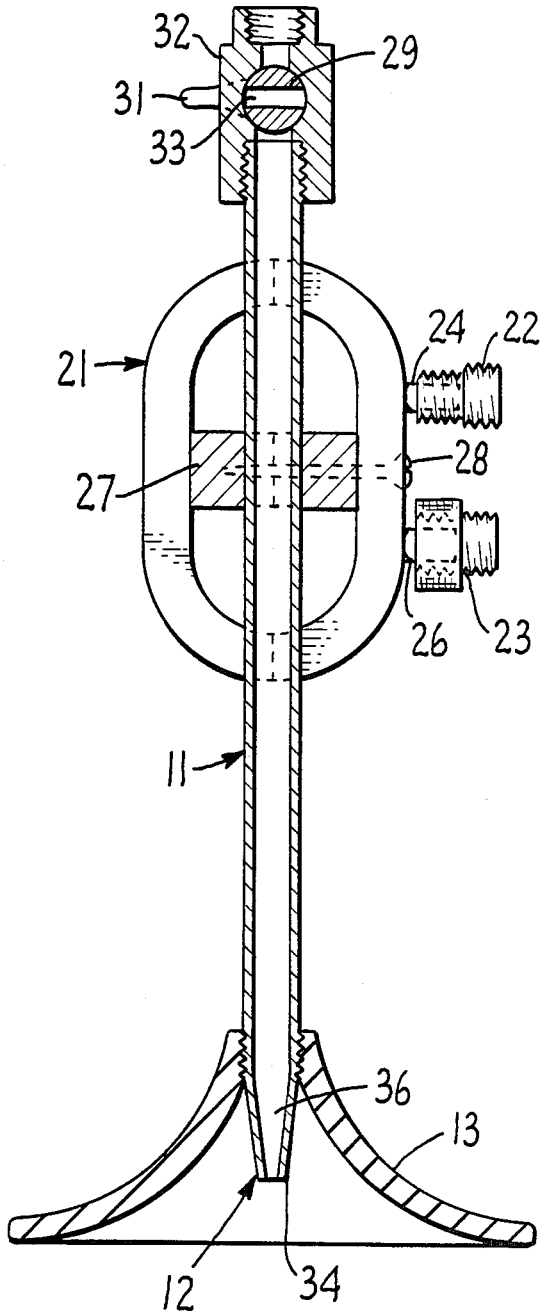
FIG. 2 is a longitudinal sectional view on an enlarged scale taken substantially on the plane of line 2—2 of FIG. 1.

While only the preferred form of the invention is illustrated in the drawings, it will be apparent that various modifications could be made without departing from the ambit of the claims.

DESCRIPTION OF THE PREFERRED EMBODIMENTS

As may be seen in the accompanying drawing, the apparatus of the present invention provides an elongated rigid tube 11 having an axial nozzle 12 at one end of the tube, a an outwardly flared splash guard carried on the end of tube 11 adjacent to nozzle 12 and providing a flexible flared skirt 13 encircling such nozzle, a manually operable valve 14 in the tube 11 at the end thereof remote from nozzle 12, a flexible hose 16 connected at one end 17 to the valve end of tube 11 and having an opposite end 18 adapted for connection to a faucet 19 or the like, and a handle 21 secured to tube 11 approximately one-third the length of said tube from the valve 14.

In accordance with the present invention, hose end 18 adapted for connection to the faucet 19 is formed for use selectively with a male hose adapter 22 and a female hose adapter 23, both of which threadably engage hose end 18, adapter 23 having inside (female) threads for engaging a faucet 19 or the like having external threads, and adapter 22 having external (male) threads for engaging a faucet 19 or the like having internal threads.

In order to prevent loss of the male and female hose adapters 22 and 23, they are removably mounted on studs 24 and 26 carried on the handle 21.

As here shown, handle 21 is of oval, ring shape, and the male and female hose adapter studs 24 and 26 are preferably mounted along one of the longer sides of the handle 21. Also as shown, the handle 21 is split vertically, and is secured to a vertically split mounting block 27 formed for clamping onto the tube 11 at the desired location when screw 28 is tightened. In this manner, the handle 21 is adjustable and may be positioned at the exact point along tube 11 where the particular user finds it to be the most useful.

The valve 14 is of the quick opening type so that the jet may be turned on abruptly for impact force and may be turned off equally abruptly. Preferably, and as here shown, valve 14 has a ball shaped internal valve member 29 connected to an external valve handle 31 capable of rotating the ball 29 around its horizontal axis. Ball 29 seats against the walls of valve housing 32 and has a bore 33 formed therethough. When valve handle 31 is operated to bring the axis of bore 33 into coaxial alignment with the axis of tube 11, water is free to flow from hose 16 through the valve and into tube 11. When valve handle 31 is operated to move bore 33 ninety degrees, access to bore 33 is cut off by the walls of the valve housing 32, thus preventing passage of water therethrough to tube 11. Such valves are often called ball plug valves.

As an important feature of the present invention, the nozzle 12 tapers smoothly inwardly from the internal diameter of tube 11 to a reduced internal diameter at the outlet end 34 of the nozzle so as to increase the velocity of the water in the jet emanating from the nozzle. The tapering internal passage 36 of nozzle 12 is made as smooth as possible so that the water can pass therethrough unimpeded except for the narrowing of passage 36. This provides maximum velocity in the water jet emanating from the nozzle to enhance the novel unclogging action of the apparatus.

From the foregoing, it will be seen that the drain flushing apparatus of the present invention is particularly effective in clearing blocked drains through use of a relatively high velocity water jet which can be controlled by the user both as to speed and direction for unblocking a wide variety of drains.

What I claim as new and desired to secure by Letters Patent is:

1. A drain clearing tool, comprising an elongated rigid tube, an axial nozzle at one end of said tube formed for directing a high velocity jet of water into the open end of a drain, an outwardly flared flexible splash guard carried on the end of said tube adjacent to said nozzle in encircling relation thereto, said flexible splash guard being formed to flare increasingly outwardly to a rim thereof so that an inner face of said flexible splash guard becomes substantially tangent to a plane perpendicular to a longitudinal axis of said tube, said splash guard extending to a point downstream of an outlet end of said nozzle whereby water from said nozzle trapped between said splash guard and said surface is easily emitted by curling back of the rim of said flexible splash guard, a manually operable quick acting valve in said tube at an end thereof remote from said nozzle, a flexible hose connected at one end to the valve end of said tube and having an opposite end adapted for connection to a faucet or the like, and a manually engagable handle mounted on said tube in laterally spaced relation thereto for holding said tube in place against the reaction forces created by said high velocity jet of water and against the action of said water bouncing back from said drain against said splash guard.

2. A drain clearing tool as described in claim 1, and wherein said end of said hose adapted for connection to a faucet is formed for use selectively with a male and a female hose adapter, and said male and female adapters are removably mounted on said manually engagable handle.

3. A drain clearing tool as described in claim 1, and wherein said manually operable quick acting valve is of the ball plug type having an external valve handle movable 90 degrees between valve open and valve closed positions.

4. A drain clearing tool as described in claim 1, and wherein said nozzle tapers smoothly inwardly from the internal diameter of said tube to a reduced internal diameter at the outlet end of said nozzle so as to increase the velocity of the water in the jet emanating from said nozzle.

5. A drain clearing tool as described in claim 1, and wherein said handle has a portion mounted in spaced parallel relation to said tube by a distance sufficient to avoid burning of a person's hand gripping said handle when household hot water is passing through said tube.

6. A drain clearing tool as described in claim 1, and wherein said handle is of oval ring shape having a first longer side secured to said tube and a second longer side in spaced relation to said tube, and said male and female hose adapters are threadably connected to the longer side of said oval ring shaped handle remote from said tube.

7. A drain clearing tube as described in claim 1, and wherein said manually engagable handle is releasably securable along the length of said tube.

* * * * *